United States Patent [19]

Hildeman et al.

[11] Patent Number: 4,464,199

[45] **Date of Patent: * Aug. 7, 1984**

[54] ALUMINUM POWDER ALLOY PRODUCT FOR HIGH TEMPERATURE APPLICATION

[75] Inventors: Gregory J. Hildeman, Murrysville; Robert E. Sanders, Jr., New Kensington, both of Pa.

[73] Assignee: Aluminum Company of America, Pittsburgh, Pa.

[ * ] Notice: The portion of the term of this patent subsequent to Apr. 12, 2000 has been disclaimed.

[21] Appl. No.: 459,287

[22] Filed: Jan. 20, 1983

Related U.S. Application Data

[63] Continuation-in-part of Ser. No. 323,181, Nov. 20, 1981, Pat. No. 4,379,719.

[51] Int. Cl.[3] ..... B22F 3/14; C22C 21/20

[52] U.S. Cl. ..... 75/249; 75/950; 420/550; 419/28; 419/48; 419/60

[58] Field of Search ..... 420/550, 551; 75/249, 75/951; 419/42, 28, 1, 48, 59, 60; 148/11.5 P

[56] References Cited

U.S. PATENT DOCUMENTS

| | | | |
|---|---|---|---|
| 2,963,780 | 12/1960 | Lyle, Jr. et al. | 29/182 |
| 3,395,001 | 7/1968 | Stroup et al. | 29/197.5 |
| 3,544,392 | 12/1970 | Lyle, Jr. et al. | 148/11.5 |
| 3,544,394 | 12/1970 | Lyle, Jr. et al. | 148/12.7 |
| 3,563,814 | 2/1971 | Lyle, Jr. et al. | 148/12.7 |
| 3,637,441 | 1/1972 | Lyle, Jr. et al. | 148/32.5 |
| 3,795,505 | 3/1974 | Corradini | 75/58 |
| 3,811,846 | 5/1974 | Schoerner et al. | 148/2 |
| 3,954,458 | 5/1976 | Roberts | 75/249 |
| 3,964,935 | 6/1976 | Wilks | 148/2 |
| 4,104,061 | 8/1978 | Roberts | 75/211 |
| 4,110,131 | 8/1978 | Gessinger | 148/11.5 N |
| 4,297,136 | 10/1981 | Pickens et al. | 75/234 |
| 4,347,076 | 8/1982 | Ray et al. | 148/11.5 P |

FOREIGN PATENT DOCUMENTS

| | | | |
|---|---|---|---|
| 2920991 | 11/1979 | Fed. Rep. of Germany | 420/550 |
| 25950 | 3/1981 | Japan | 420/551 |
| 1138246 | 12/1968 | United Kingdom | 148/11.5 P |

OTHER PUBLICATIONS

"Advanced Methods Used in Superalloy Formulation", Mayfield, J., *Aviation Week & Space Technology,* Jan. 26, 1981, pp. 46–47, 49.

*Primary Examiner*—L. Dewayne Rutledge
*Assistant Examiner*—John J. Zimmerman
*Attorney, Agent, or Firm*—Carl R. Lippert

[57] ABSTRACT

Aluminum alloy atomized powder containing 4 to 15% iron and 1 to 12% cerium or other rare earth metal, when properly compacted and shaped into a useful article, exhibits very high strength at relatively high temperatures. The iron content exceeds the cerium or rare earth metal content, and the powder may contain refractory elements such as W, Mo and others. The powder is produced by atomizing alloyed molten aluminum, preferably in a nonoxidizing atmosphere, and is compacted to a density approaching 100% under controlled conditions including controlled temperature conditions. The alloy may be subsequently shaped by conventional forging, extruding or rolling processes.

26 Claims, No Drawings

ALUMINUM POWDER ALLOY PRODUCT FOR HIGH TEMPERATURE APPLICATION

The invention here described was made in the course of or under a contract or subcontract thereunder with the United States Air Force.

CROSS-REFERENCE TO RELATED APPLICATIONS

This application is a continuation-in-part application of U.S. Ser. No. 323,181, filed Nov. 20, 1981, and now U.S. Pat. No. 4,374,719.

BACKGROUND OF THE INVENTION

This invention relates to the production of improved aluminum alloy powder-derived products characterized by high yield strength at temperatures of 450° to 500° F. and therefore useful in aircraft and other important applications and to methods for producing the same to assure such high property levels.

Aluminum alloys have enjoyed wide use in important applications such as aircraft where aluminum has become well known for its high stength to weight ratio. However, because of aluminum's limitations at elevated temperatures such as 400° to 500° F., aluminum is often considered less suitable than metals such as titanium since temperatures in that range degrade the strength of conventional aluminum alloys produced from ingot. For instance, forgings of aluminum alloy 2219 (5.8–6.8% Cu, 0.2–0.4% Mn, 0.05–0.15% V, 0.1–0.25% Zr, 0.02–0.1% Ti) in the T852 temper are considered to have impressive moderate temperature yield strength, but they fall far short of a desired yield strength level of over 30,000 psi at temperatures of about 450° to 500° F. Another approach to improve the elevated temperature strength of aluminum components is to utilize alloys that are fabricated from rapidly quenched aluminum base powders which rely on fine intermetallic particles for dispersion strengthening. For instance, U.S. Pat. No. 2,963,760 to Lyle and Towner discloses aluminum alloy powder products containing iron with or without manganese, nickel, cobalt, chromium, vanadium, titanium or zirconium, and that such are advantageous respecting strength at elevated temperatures, but these alloys and products also do not exceed 30,000 psi yield strength at 450° F. Various other work has gone forward toward achieving high temperature strength in aluminum but the results have often been inconsistent, and where good strength is achieved such is often at the expense of good elongation, thus limiting the usefulness of such products which desirably have elongation exceeding 4%, for instance desirably 4½% or 5% or more. For instance, an elongation of 5½% or 6% or more combined with a yield strength of 30,000 or 35,000 psi at 450° F. would be highly desirable in an aluminum powder-derived product, but achieving such has presented difficulties.

One recently promising inroad involves aluminum-iron-cerium alloys (Air Force Material Lab Contract F33615-77-C-5086) and the present improvement concerns methods for producing aluminum-iron-cerium powder aluminum products having good strength at elevated temperatures.

DESCRIPTION

In accordance with the invention, aluminum-iron-cerium (or other rare earth metal) powder products are compacted and shaped into useful structures having very high strength, for instance exceeding 30,000 or even 40,000 pounds per square inch yield strength at temperatures of 450° F. or even higher. The alloy composition includes 4 to 12% iron and 1 to 7% cerium or other rare earth metal, all percentages and ratios herein being by weight unless indicated otherwise. Rare earth metals refer to the Lanthanide series from Period 6 of the Periodic Table, with cerium being preferred. The iron content should exceed the rare earth metal content with the weight ratio ranging from 1.2 to 4.4:1, preferably 1.5 to 3.5:1, in favor of iron. In addition to aluminum, iron and cerium or other rare earth metal, the powder alloys can contain refractory metals of up to 2.5% tungsten, 2.5% tantalum, 1.5% molybdenum and 1.5% niobium. Preferably the total amount of these additional strengtheners should not exceed 5% and preferably should not exceed the iron and cerium content. The function of refractory metal additions is to improve strength at high temperatures, and to be effective for such purpose the additions are preferably 0.1% or more.

The preferred alloy composition may range from 6 to 10% iron, 2 to 6% cerium, with 0.9 to 1.5% tungsten or tantalum or 0.3 to 0.9% molybdenum or niobium, with the balance aluminum.

It is desired that the oxide content of the powder not exceed 0.6%. Since the improved powders contain both iron and cerium, a mixture of rare earth elements (atomic numbers 57–71) typically containing about 50% cerium, with lesser amounts of lanthanum, neodymium, praseodymium and other rare earths, is an economical and practical source for cerium. The normal impurities of 0.1% in misch metal of iron and magnesium are acceptable. Hence, misch metal can be employed as the source of cerium or other rare earth element on a one-for-one weight basis. For instance, 4% misch metal is equivalent to or can be substituted for 4% cerium in practicing the improvement.

The alloys are preferably produced as powders by atomizing a well-mixed superheated molten alloy although other particulate production techniques, such as splat or melt spun ribbon methods that also are capable of achieving rapid quenching, are believed also suitable for production of alloy particulate in practicing the invention. It is preferred that atomization be carried out in the absence of an oxidizing condition or gas in order to reduce the oxide content of the powder. Flue gas has been found to be adequate although other nonoxidizing gases also may serve the purpose. Atomizing conditions should be carried out to produce atomized particles of a size finer than 100 mesh, preferably such that at least 85% pass through a 325 mesh screen (Tyler Series).

The powder is then compacted at high temperature in a vacuum. However, prior to vacuum high temperature compaction, the powders may be isostatically compressed into a cohesive or coherent shape. This can be effected by placing the powders within a bag, such as a rubber or plastic material, which in turn is placed within a hydraulic media for transmitting pressure through the bag to the powder. Pressures are then applied in the range of 5 to 60 psi which compress the powder into a cohesive shape of about 65 to 90% of full density. This isostatic compaction step facilitates handling of the powder. With or without preliminary isostatic compaction, the material is compacted to substantially full density at relatively high temperatures. This can be effected by placing the powder or the isostatically compacted material in a container and evacuating the container at room temperature and heating to temperatures of 675° F., preferably 700° or 750° to 800° F., while continuing to pull a vacuum down to a pressure level of one torr, preferably $10^{-1}$ or $10^{-2}$ torr or less (1 torr=1 mm Hg at 0° C.). While still in the sealed container, the material is compressed to substantially full density at temperatures of 675° to 950° F., preferably 700° to 800° F. When referring to substantially full density, it is intended that the compacted billet be substantially free of porosity with a density equal to 95% or more of the theoretical solid density, preferably 98 or 99% or more. It is desired that the vacuum compaction to full density be effected at a minimum temperature greater than 650° F., for instance 675° F. or higher, and preferably at a minimum temperature of 700° F. or higher. The maximum temperature for compaction should not exceed 950° or 1000° F. and is preferably not over 800° to 850° F.

After being compacted to substantially full density at elevated temperature and vacuum conditions as just described, the container may be removed from the compact which can then be shaped such as by forging, rolling, extruding or the like or can be machined into a useful shape. It is preferred that the compact be worked by any amount equivalent to a reduction in cross section of at least 25%, preferably 50 or 60% or more, where practical, since such favors improved elongation properties. Preferred working temperatures range from 550° to 850° F.

To illustrate the improvement achieved in practicing the invention, atomized powders were formulated containing nominally 7.5 to 8% iron and 3.3 to 3.6% cerium, balance aluminum and trace impurities. The powders were produced by atomization in flue gas which kept the oxide content low and under conditions to provide for 90% of the powders passing through a 325 mesh (Tyler Series) screen. In each case the powders were initially isostatically compacted by placing inside elastic bags situated within hydraulic media through which isostatic compaction was achieved at room temperature. The isostatic pressure was 30,000 psi. The compacted powders were placed in aluminum containers which were evacuated at room temperature to a pressure of less than 0.1 torr, after which said vacuum was maintained while heating to an elevated temperature. In Examples 1, 2, 3 and 4 the elevated temperatures for vacuum hot pressing were 600°, 650°, 700° and 750° F., respectively. While still in the sealed containers, the compacted powders were pressed to full density at their respective temperatures. Thereafter, cylindrical forging preforms were machined from the hot pressed billet and upset to a 40% reduction in height. Table 1 below sets forth the properties for Examples 1, 2, 3 and 4, and comparison properties are included for a forged alloy 2219 in T852 temper. The table is based on tensile and yield strengths and percent elongation at 450° F. after 1000 hours exposure to said temperature.

TABLE 1

| | Elevated Temperature Strength at 450° F. | | | |
|---|---|---|---|---|
| Example | Vacuum Compaction Temperature | Tensile Strength psi | Yield Strength (0.2% offset) psi | % Elong. |
| 1 | 600° F. | 58,000 | 52,500 | 2.0 |
| 2 | 650° F. | 57,000 | 49,500 | 4.0 |
| 3 | 700° F. | 54,100 | 47,200 | 5.0 |
| 4 | 750° F. | 49,000 | 38,600 | 6.5 |
| 2219-T852 | | 31,000 | 27,000 | 18.0 |

From the foregoing table it can be seen that Examples 1, 2, 3 and 4 exhibit a significant improvement in yield strength over 2219-T852 but that Example 3 and particularly Example 4 exhibit a significant improvement in elongation over Examples 1 and 2 which is a highly important property in addition to yield strength for high temperature structural applications, thus demonstrating the significance of the improvement wherein vacuum compaction proceeds at elevated temperatures above 650° F., preferably at 700° F. and higher. Thus, the invention readily achieves good strength and elongation properties at 450° F. characterized by yield strength of 30,000 or 35,000 psi or more and elongation of 5 or 5½% or even 6% or more. Further tests have verified that misch metal can be substituted for cerium on a one-for-one basis with good results.

In addition to the hereinbefore set forth preferred practices, other practices are also considered useful in practicing the invention. In a broader sense, the invention should encompass compositions within the broad range of 4% to 15% iron and 1 to 12% cerium or other rare earth element with the ratio of iron to rare earth ranging from about 0.5 to 5:1. The inverse ratio of 0.2 to 2:1 applies to the ratio of rare earth to iron. Thus, in addition to the hereinbefore set forth preferred compositions, these broader ranges include compositions containing 12% or more to 15% iron and include compositions containing 7% or more to 12% cerium or other rare earth elements along with compositions wherein the ratio of iron to rare earth ranges from 0.5:1 to 1.2 (or less):1 and from 4.4 (or more):1 to 5:1.

Examples of further suitable compositions for the practice of the invention are set forth in Table 2.

TABLE 2

| Composition (wt. %) | Fe/Ce Ratio |
|---|---|
| 6 Fe, 12 Ce, bal. Al* | 0.5:1 |
| 10 Fe, 10 Ce, bal. Al | 1:1 |
| 15 Fe, 3 Ce, bal. Al | 5:1 |

* balance aluminum and incidental elements and impurities

While the invention has been described in terms of preferred embodiments, the claims appended hereto are intended to encompass all embodiments which fall within the spirit of the invention.

What is claimed is:

1. A method of producing an improved aluminum article having high strength at elevated temperatures, comprising the steps:

(a) providing aluminum alloy particulate consisting essentially of 4 to 15% iron, 1 to 12% rare earth metal, balance aluminum and impurities and incidental elements, the weight ratio of iron to rare earth metal falling within the range of 0.5 to 5:1; and (b) compacting said powder under vacuum at a pressure of one torr or less and elevated temperature conditions wherein said powders are compacted to at least 95% of full density at a temperature greater than 650° F.

2. The improvement according to claim 1 wherein the rare earth metal is selected from the group consisting of cerium and Misch metal.

3. The method according to claim 1 wherein said particulate contains from above 7% to 12% rare earth element.

4. The method according to claim 1 wherein said particulate contains from over 12% to 15% iron.

5. The method according to claim 1 wherein the ratio of iron to rare earth element ranges from about 0.5:1 to less than 1.2:1.

6. The method according to claim 1 wherein the ratio of iron to rare earth element ranges from above 4.4:1 to about 5:1.

7. The improvement according to claim 1 wherein said particulate additionally contains one or more elements from the group of up to 2.5% tungsten, up to 2.5% tantalum, up to 1.5% molybdenum and up to 1.5% niobium.

8. The improvement according to claim 1 wherein said particulate is produced by atomizing a superheated melt in a nonoxidizing atmosphere.

9. The improvement according to claim 8 wherein said nonoxidizing atmosphere is flue gas.

10. The improvement according to claim 1 wherein said vacuum compaction is effected at a temperature of at least 700° F.

11. The improvement according to claim 1 wherein said aluminum particulate contains less than 0.6% aluminum oxide.

12. The improvement according to claim 1 wherein substantially concurrently with said vacuum compaction the compact is upset equivalent to a reduction of at least 25%.

13. The method according to claim 1 wherein subsequent to said vacuum compaction the compact is worked equivalent to a reduction of at least 25% at a temperature within the range of 550° to 850° F.

14. The improvement according to claim 1 wherein said improved article exhibits high strength at elevated temperatures characterized by a yield strength of at least 30,000 psi and elongation of at least 5% at 450° F. after 1000 hours exposure to said temperature.

15. A method of producing an improved aluminum article having high strength at elevated temperatures, comprising the steps:

(a) providing atomized aluminum alloy powder consisting essentially of 4 to 15% iron, 1 to 12% of at least one metal from the group consisting of cerium and Misch metal, balance aluminum and impurities and incidental elements, the weight ratio of iron to cerium plus Misch metal ranging between 0.5 and 5:1;

(b) vacuum compacting said powder at a pressure not exceeding 0.1 torr and a temperature of 700° to 850° F. under sufficient compaction to produce a compact at least 98% of full density; and (c) working said compact at a temperature of 550° to 850° F. equivalent to a cross-sectional reduction of at least 25% to produce said article characterized by a yield strength of at least 35,000 psi and elongation of at least 5½% at a temperature of 450° F.

16. The improvement according to claim 15 wherein said aluminum alloy powder additionally contains one or more elements from the group of up to 2.5% tungsten, up to 2.5% tantalum, up to 1.5% molybdenum and up to 1.5% niobium, the combined total of said additional elements not exceeding 5%.

17. The improvement according to claim 15 wherein, prior to said compaction, said powder is isostatically compacted at room temperature to a cohesive shape exhibiting at least 65% of full density which said isostatically compacted cohesive shape is then compacted at said elevated temperature and vacuum condition according to said step (b) of claim 15.

18. The improvement according to claim 15 wherein said working of said step (c) is equivalent to a reduction of at least 50% in cross-section.

19. The aluminum article produced by the method of claim 1.

20. The aluminum article produced by the method of claim 3.

21. The aluminum article produced by the method of claim 4.

22. The aluminum article produced by the method of claim 5.

23. The aluminum article produced by the method of claim 6.

24. The aluminum article produced by the method of claim 7.

25. The aluminum article produced by the method of claim 15.

26. The aluminum article produced by the method of claim 16.

* * * * *

UNITED STATES PATENT AND TRADEMARK OFFICE

CERTIFICATE OF CORRECTION

PATENT NO. : 4,464,199

DATED : August 7, 1984

INVENTOR(S) : Gregory J. Hildeman and Robert E. Sanders, Jr.

It is certified that error appears in the above-identified patent and that said Letters Patent is hereby corrected as shown below:

Col. 1, line 13 Change "4,374,719" to --4,379,719--.

Col. 1, line 24 Change "stength" to --strength--.

Signed and Sealed this

*Fourteenth* Day of *May 1985*

[SEAL]

*Attest:*

DONALD J. QUIGG

*Attesting Officer* *Acting Commissioner of Patents and Trademarks*